US005964603A

United States Patent [19]

Hanazaki et al.

[11] Patent Number: 5,964,603

[45] Date of Patent: Oct. 12, 1999

[54] LOW INSERTION FORCE CONNECTOR OF A SLIDE TYPE

[75] Inventors: Hisashi Hanazaki; Mitsuo Endo, both of Shizuoka, Japan

[73] Assignee: Yazaki Corporation, Tokyo, Japan

[21] Appl. No.: 08/937,614

[22] Filed: Sep. 25, 1997

[30] Foreign Application Priority Data

Sep. 30, 1996 [JP] Japan ..... 8-259337

[51] Int. Cl.[6] ..... H01R 13/62

[52] U.S. Cl. ..... 439/157; 439/152

[58] Field of Search ..... 439/152–160, 439/342, 296, 347–8, 372

[56] References Cited

U.S. PATENT DOCUMENTS

| | | | |
|---|---|---|---|
| 4,586,771 | 5/1986 | Kraemer et al. . | |
| 5,183,408 | 2/1993 | Hatagishi | 439/147 |
| 5,618,194 | 4/1997 | Maue et al. | 439/157 |
| 5,618,195 | 4/1997 | Cappe | 439/157 |
| 5,785,540 | 7/1998 | Jacklin | 439/157 |

FOREIGN PATENT DOCUMENTS

| | | |
|---|---|---|
| 0 382 344 | 8/1990 | European Pat. Off. . |
| 61-203581 | 9/1986 | Japan . |
| 6-5148 | 1/1994 | Japan . |

*Primary Examiner*—Lincoln Donovan

*Attorney, Agent, or Firm*—Sughrue, Mion, Zinn, Macpeak & Seas, PLLC

[57] ABSTRACT

In the low insertion force connector of a slide type, one connector housing 10 includes in the interior portion thereof a guide member 20, and a lock engaging portion 22 formed on the fitting side of the guide member 20; the other connector housing 30 includes a pair of flexible lock arms 33 provided through a pair of slits 32 respectively formed in the two side walls in the longitudinal direction thereof, and a pair of lock hold portions 34 respectively formed in the mutually opposing inner walls of the lock arms 33 and on the fitting side thereof; and, if the lock engaging portion 22 is engaged with the lock hold portions 34, then one and the other connector housing 10 and 30 can be secured to each other temporarily. The guide member 20 is held in a stand-up condition substantially in the central portion of one connector housing 10, while the lock arms 33 are situated substantially in the central portion of the other connector housing 30 in such a manner that they correspond in position to the guide member 20. Guide grooves 18 are respectively formed in the inner wall surfaces of the two longitudinal side walls of one connector housing 10, in particular, substantially at the central position thereof as well as on the fitting side thereof.

4 Claims, 12 Drawing Sheets

LOW INSERTION FORCE CONNECTOR OF A SLIDE TYPE

BACKGROUND OF THE INVENTION

The present invention relates to a low insertion force connector of a slide type in which a pair of connector housings are fitted with each other by inserting a slide member through a cam mechanism.

Conventionally, there is proposed a connector assembly (for example, shown in Japanese Patent Unexamined Publication No. Sho. 61-203581) in which, by inserting a slide member into one of a pair of connector housings, the two connector housings can be fitted with each other with a low insertion force through use of a cam mechanism.

In FIG. 1, the conventional connector assembly 70 comprises one housing 71, the other housing 72, and a cam follower 73. In a state that one housing 71 is assembled to the cam following body 73, as shown in FIG. 2, the other housing 72 is fitted into one housing 71. If the cam following body 73 is moved to the right direction, then the follower 74 of the cam following body 73 moves through the slot 75 of one housing 71 and the cam track 76 of the other housing 72, so that, as shown in FIG. 3, one housing 71 and the other housing 72 can be fitted with each other.

However, as shown in FIG. 1, while the cam following body 73 moves from the middle portion 76*b* of the cam track 76 to the inner end portion 76*c*, one housing 71 and the other housing 72 are both held in unstable conditions and, therefore, in an operation to fit one housing 71 with the other housing 72, the two housings 71 and 72 must be supported by hands or the like, with the result that the operation to fit one housing 71 with the other housing 72 is troublesome.

SUMMARY OF THE INVENTION

It is an object of the invention to solve the above-mentioned problem, and particularly to provide a low insertion force connector of a slide type which, when fitting one and the other connector housings with each other, can carry out the fitting operation in such a manner that the two connector housings can be held in a stable manner.

The above object can be achieved by a low insertion force connector of a slide type, according to the invention, in which a pair of connector housings are fitted with each other with a cam mechanism by inserting a slide member, the low insertion force connector of a slide type comprising:

- a guide member formed in an interior portion of one of the connector housings and being movable advanceably and retreatably in the fitting direction of the connector housings;
- a lock engaging portion formed in the interior portion of the one of the connector housings and formed on the fitting side of the guide member;
- a pair of flexible lock arms provided through a pair of slits respectively formed in the two side walls in the longitudinal direction of the other of the connector housings; and
- a pair of lock hold portions respectively formed in the mutually opposing inner wall surfaces of the lock arms and on the fitting side of the other of the connector housings;
- wherein the connector housings are secured to each other temporarily by engaging the lock engaging portion with the lock hold portions.

With the construction above, the guide member is movable advanceably and retreatably in the fitting direction within one connector housing, while the lock engaging portion formed on the fitting side of the guide member is expanded out from the guide member. The lock arms respectively provided in the other connector housing through a pair of slits are flexible, while the lock hold portions formed by expansion in the inner wall surfaces of the lock arms are opposed to each other. If the other connector housing is pushed into one connector housing, then the lock hold portions are butted against the lock engaging portion to thereby open the lock arms, so that the lock engaging portion is stored into between the lock arms and thereafter the lock arms are allowed to restore elastically and are then closed. As a result of this, one connector housing and the other connector housing are temporarily secured to each other.

In the above-mentioned construction, there may be provided a low insertion force connector of a slide type, in which the above-mentioned guide member is held in a stand-up condition substantially in the central portion of the above-mentioned one connector housing, while the above lock arms are situated substantially in the central portion of the other connector housing in such a manner that they correspond in position to the guide member.

With the construction above, since the position of provision of the guide member lies substantially in the central portion of one connector housing and also the position of provision of the lock arms lies substantially in the central portion of the other connector housing in correspondence to the position of provision of the guide member, when one and the other connector housings are fitted with each other, the two connector housings are not inclined either in the right or left directions but are stabilized.

Further, in the above-mentioned construction, there may be provided a low insertion force connector of a slide type, in which the guide grooves are respectively formed in the inner wall surfaces of the two longitudinal side walls of one connector housing, in particular, substantially at the central position thereof as well as on the fitting side thereof.

With the above-mentioned construction, because one connector housing includes notches formed in the inner wall surfaces of the two longitudinal side walls thereof at substantially central position as well as on the fitting side thereof, the lock arms can be opened with sufficient room.

DETAILED DESCRIPTION OF THE PREFERRED EMBODIMENTS

Now, description will be given below of a concrete embodiment of a low insertion force connector of a slide type with reference to the accompanying drawings.

FIGS. 4–15 respectively show an embodiment of a low insertion force connector of a slide type according to the invention.

Figure 1:
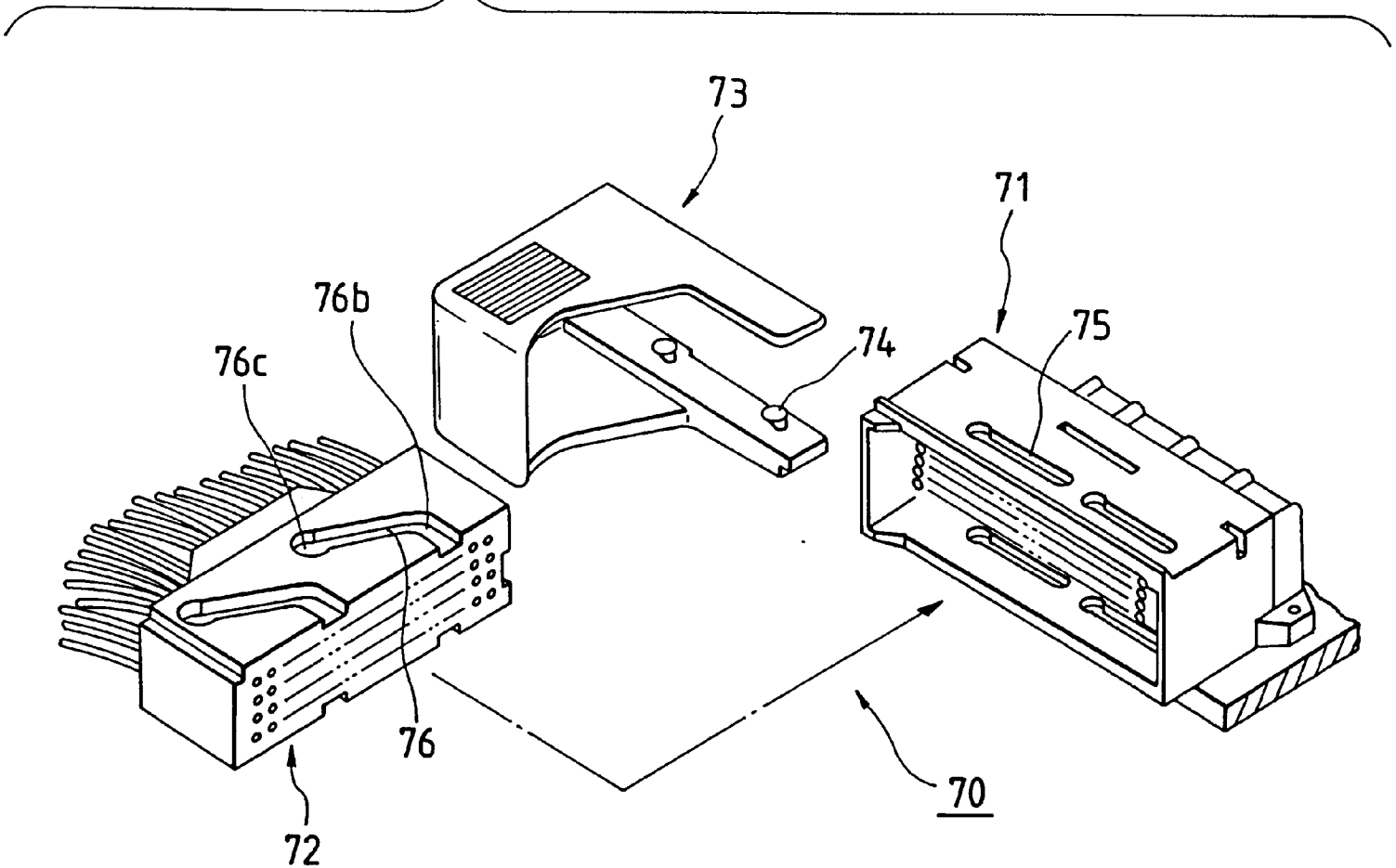
FIG. 1 PRIOR ART
FIG. 1 an exploded perspective view of a conventional connector assembly.
Figure 2:
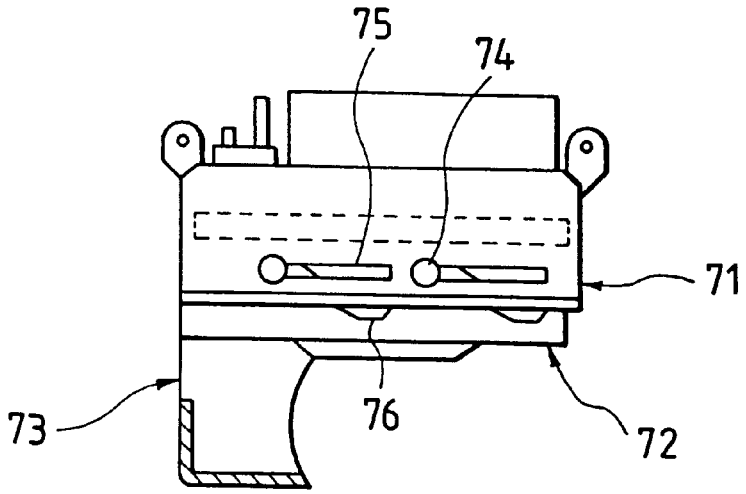
FIG. 2 PRIOR ART
FIG. 2 is an explanatory view of an initial fitting state of the connector assembly shown in FIG. 1.
Figure 3:
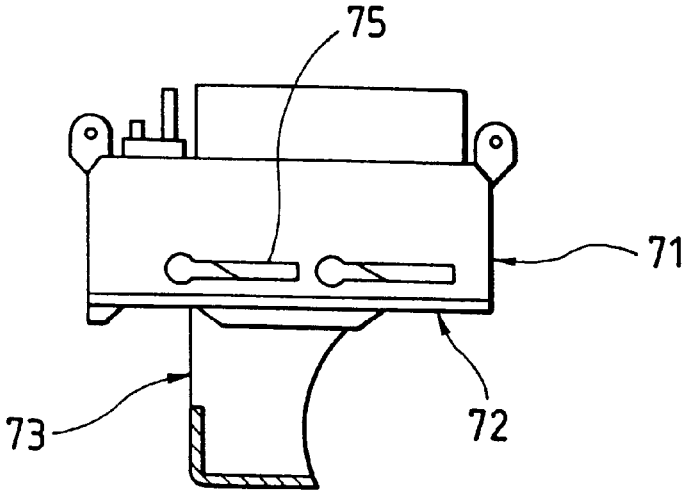
FIG. 3 PRIOR ART
FIG. 3 is an explanatory view of a state in which the fitting of the connector assembly shown in FIG. 2 is completed.
Figure 4:
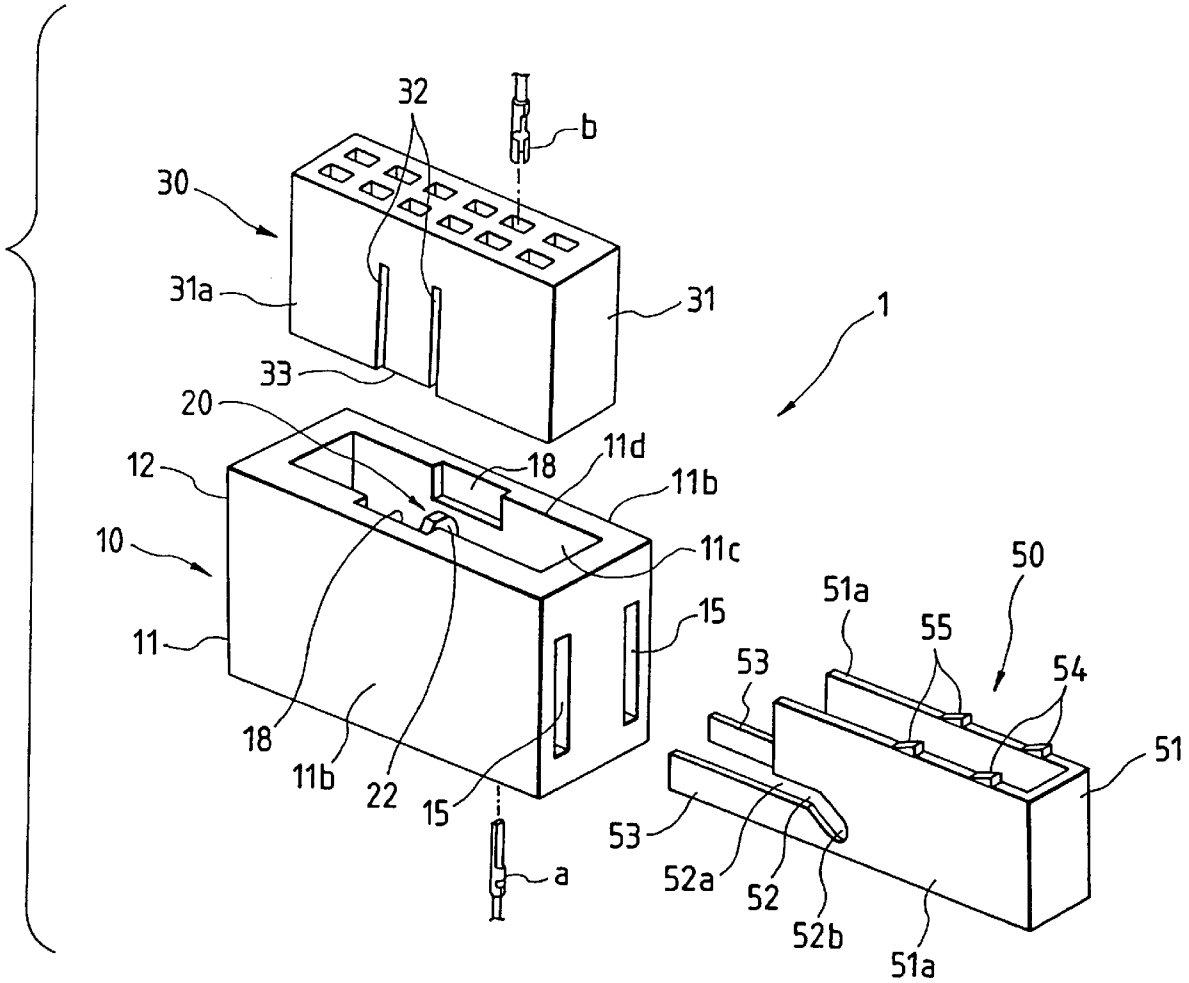
FIG. 4 is an exploded perspective view of an embodiment of a low insertion force connector of a slide type according to the invention.

In FIG. 4, the present low insertion force connector of a slide type comprises one connector housing 10, the other connector housing 30, and a slide member 50, in which, by inserting the slide member 50 into one connector housing 10, one connector housing 10 and the other connector housing 30 can be fitted with each other.

Figure 5:
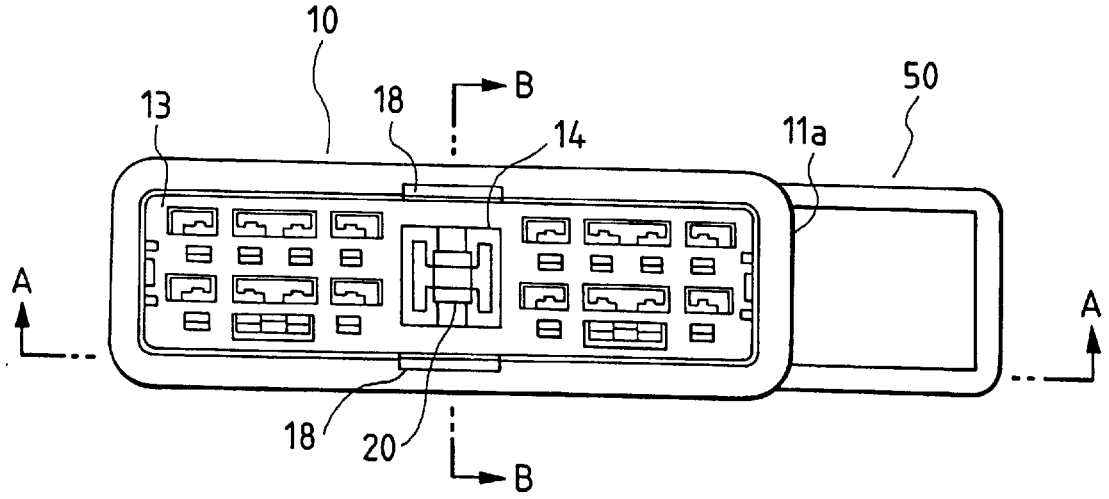
FIG. 5 is a plan view of one connector housing and a slide member employed in the above embodiment.
Figure 6:
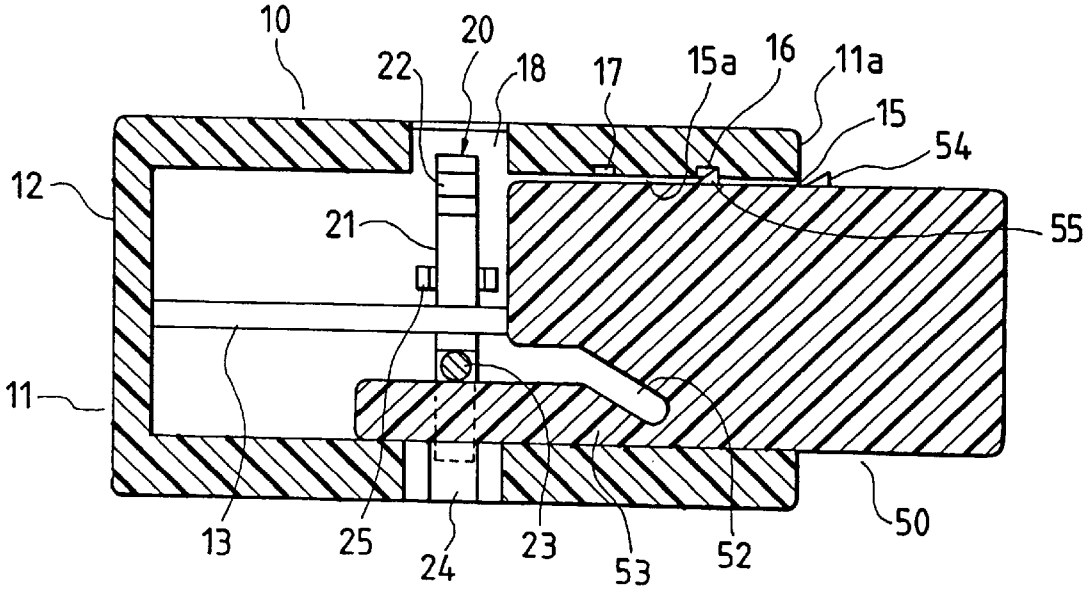
FIG. 6 is a section view taken along the direction A—A shown in FIG. 5.
Figure 7:
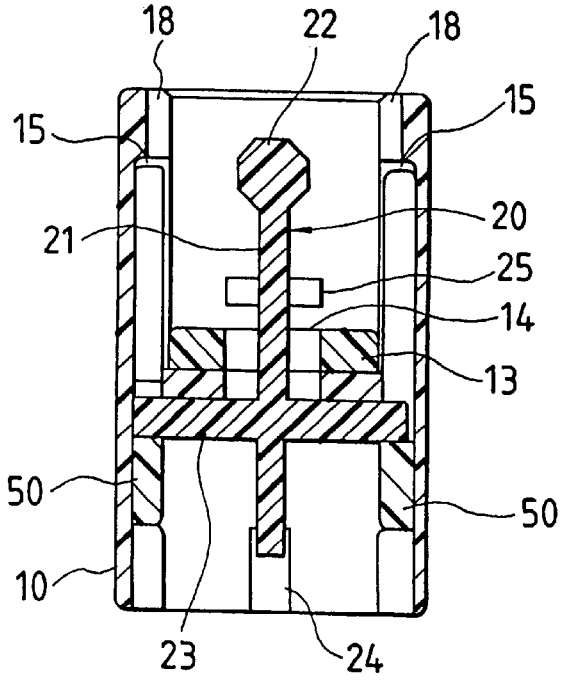
FIG. 7 is a section view taken along the direction B—B shown in FIG. 5.

As shown in FIGS. 5, 6 and 7, one connector housing 10 comprises a housing main body 11 including a terminal holder 13 for holding a terminal a, and a hood portion 12 for receiving the other connector housing 30 into the housing main body 11, in which a rectangular hole 14 is formed substantially in the central portion of the terminal holder 13, there is provided a guide member 20 movable advanceably and retreatably through the rectangular hole 14 in the fitting direction of the other connector housing 30, there is formed in one side wall 11*a* of the housing main body 11 an insertion hole 15 for inserting a slide member 50 in the longitudinal direction of one connector housing 10, a first securing groove 16 and a second securing groove 17 are formed in the inner wall surface of the insertion hole 15, and guide grooves 18 and 18 are formed on the upper edges 11*d* side of the inner surfaces 11c of the two longitudinal walls 11*b* and 11*b* of the housing main body 11.

Figure 8:
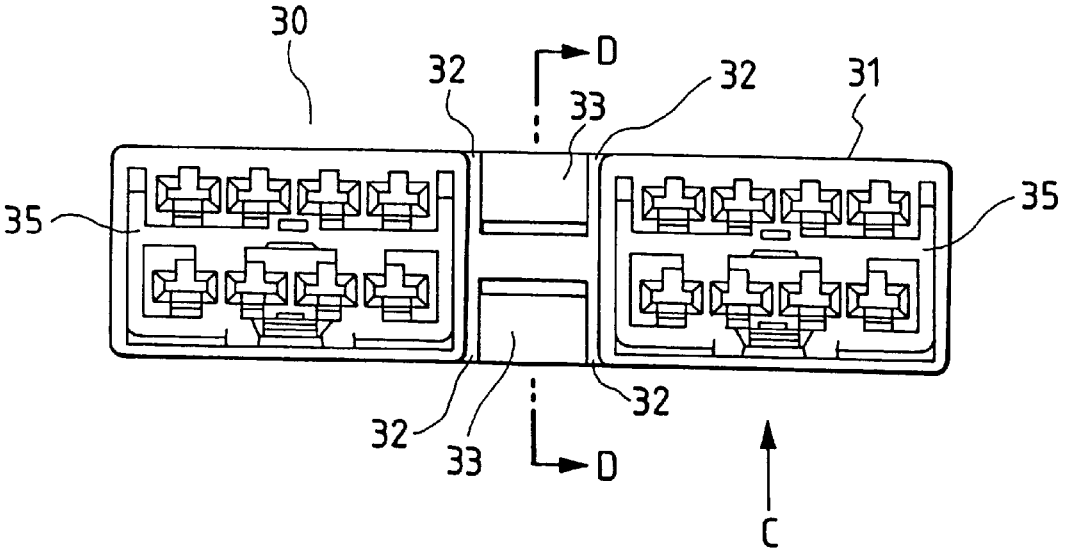
FIG. 8 is a plan view of the other connecting housing employed in the above embodiment.
Figure 9:
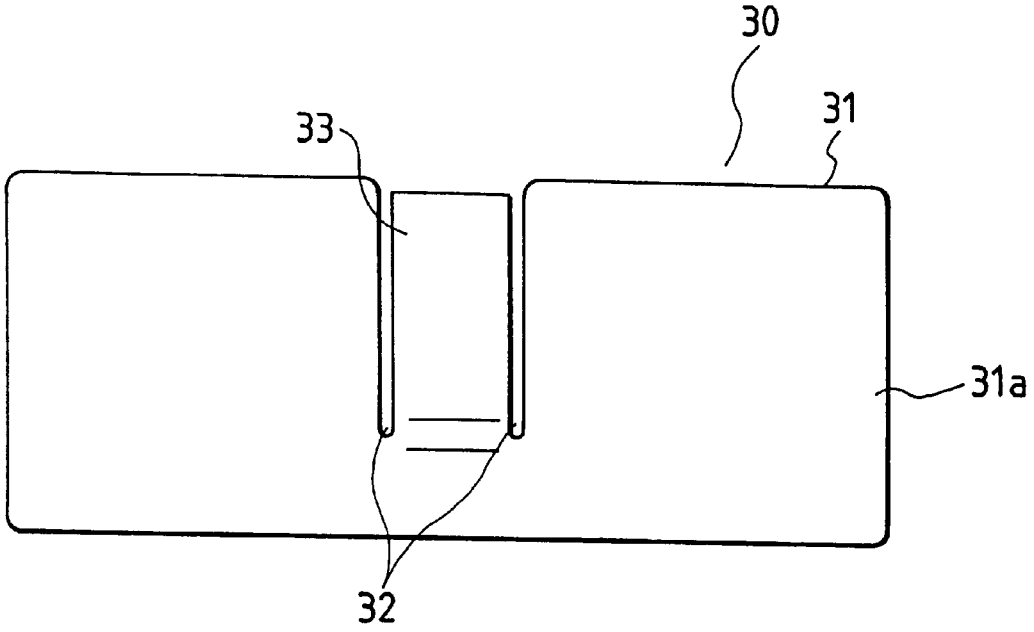
FIG. 9 is a view taken along the C direction shown in FIG. 8.
Figure 10:
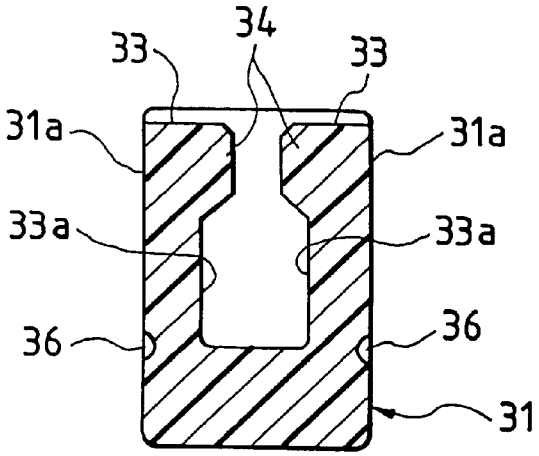
FIG. 10 is a section view taken along the direction D—D shown in FIG. 8.

As shown in FIGS. 8, 9 and 10, the other connector housing 30 is structured such that a pair of slits 32 are respectively cut formed in the longitudinal side walls 31*a* of a housing main body 31 to thereby provide a pair of flexible lock arms 33, lock hold portions 34 are respectively formed by expansion on the fitting sides of the mutually opposing inner wall surfaces, 33*a* of each lock arm 33, and terminal holders 35 for holding a terminal b are provided on the two sides of the lock arm 33. By the way, in order to increase the flexibility of the lock arm 33, preferably, notches 36 may be formed in the base portion of the lock arm 33, as shown in FIG. 10.

As shown in FIGS. 6 and 7, the guide member 20 comprises a rod-shaped main body portion 21, a lock engaging portion 22 formed by expansion in the leading end (on the side of the other connector housing 30) and having a hexagonal section, and a cam follower 23 provided on the trailing end side of the guide member 20 in such a manner that it projects out in a direction extending at right angles to the insertion direction of the slide member 50. The rear or tailing end of the main body portion 21 is held by a hollow cylindrical hold portion 24 in an stand-up manner. Also, the central portion of the main body portion 21 is held by a support portion 25, thereby preventing the guide member 20 from being turned over.

Figure 16:
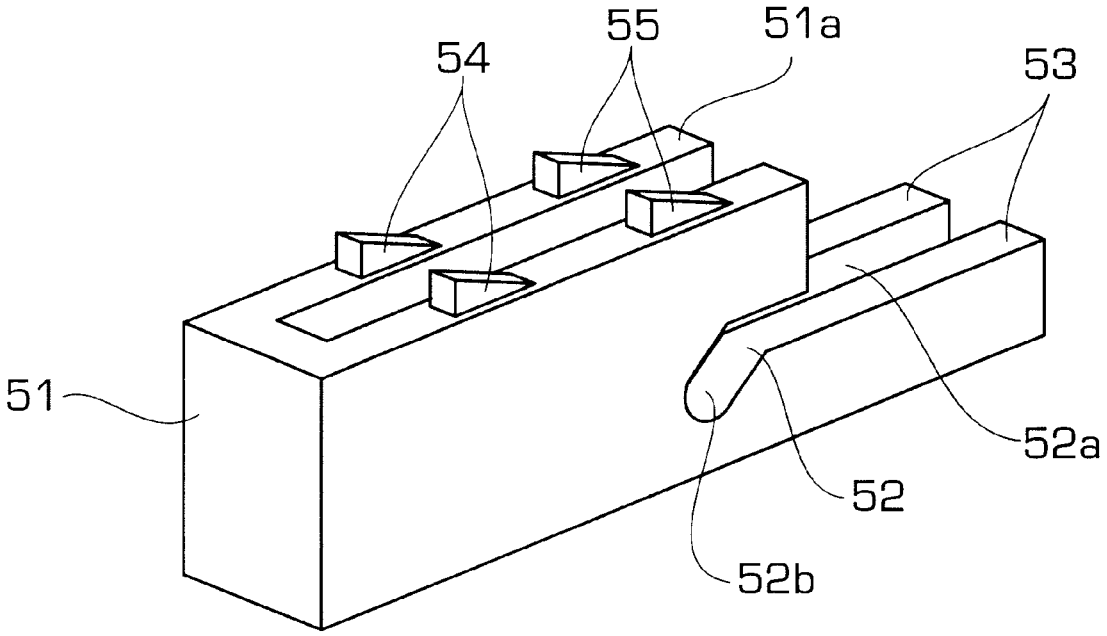
FIG. 16 is a perspective view of an embodiment showing another view of the cam groove of the slide member.

As shown in FIGS. 4 and 16, the slide member 50 includes two cam grooves (52), which are respectively formed in the two mutually opposing side walls 51*a*of a frame-like main body 51 which is formed in a U shape, two guide rails 53 which are used to guide the cam follower 23 into the cam grooves 52, and first and second securing pieces 54 and 55 respectively provided at positions which correspond to the first and second securing grooves 16 and 17 of one connector housing 10. Each of the cam grooves 52 includes an entrance portion 52*a* and inner end portion 52*b*. The entrance portion 52*a* is formed in parallel to the guide rail 53, while the inner end portion 52*b* is formed in such a manner that it is inclined downward from the entrance portion 52*a*. By the way, it is also possible to form the first and second securing pieces 54 and 55 in such a manner that they are free to flex.

Next, description will be given below of a case in which one connector housing 10 and the other connector housing 30 can be fitted with each other by inserting the slide member 50.

Figure 11A:
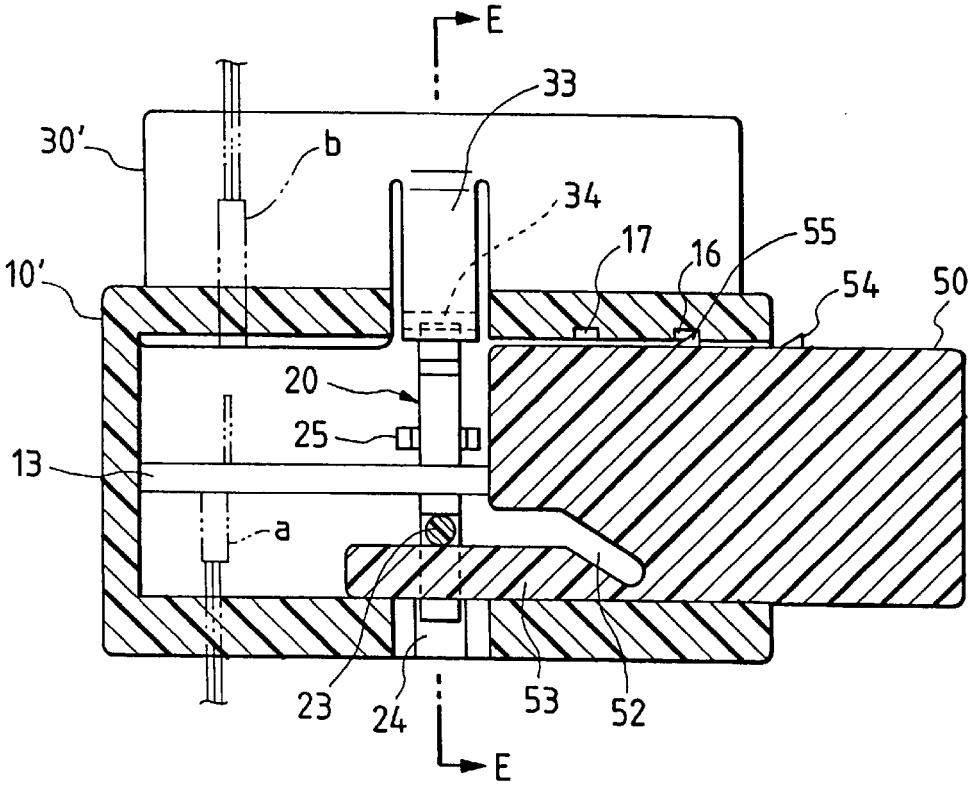
FIGS. 11(*a*) and 11(*b*) is explanatory views of a process for fitting one and the other connector housings with each other, showing a state before one and the other connector housings are temporarily secured to each other; in particular, (*a*) is a longitudinal section view of one and the other connector housings, and (*b*) is a section view taken along the direction E—E shown in (*a*)
Figure 11B:
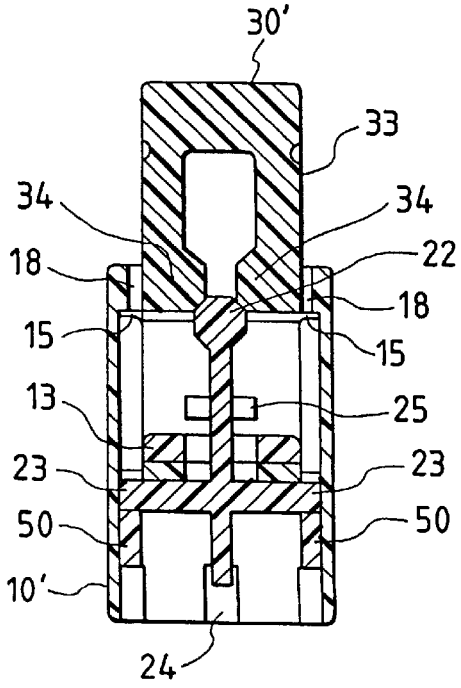

At first, as shown in FIGS. 11(*a*) and (*b*), the terminal a is inserted into one connector housing 10 and is then secured to the terminal holder 13 and, at the same time, the terminal b is inserted into the other connector housing 30 and is then secured to the terminal holder 35.

In a state in which the slide member 50 is inserted into the insertion hole 15 and the first securing grooves 16 are engaged with the second securing pieces 55, the insertion of the slide member 50 is interrupted temporarily. At the then time, the cam follower 23 is placed on the guide rails 53. If the other connector 30' (a state in which the terminal b is inserted into and secured to the other connector housing 30) is pushed into one connector 10' (a state in which the terminal a is inserted into and secured to one connector housing 10), then the lock hold portions 34 of the lock arms 33 are butted against the lock engaging portion 22 of the guide member 20.

Figure 12A:
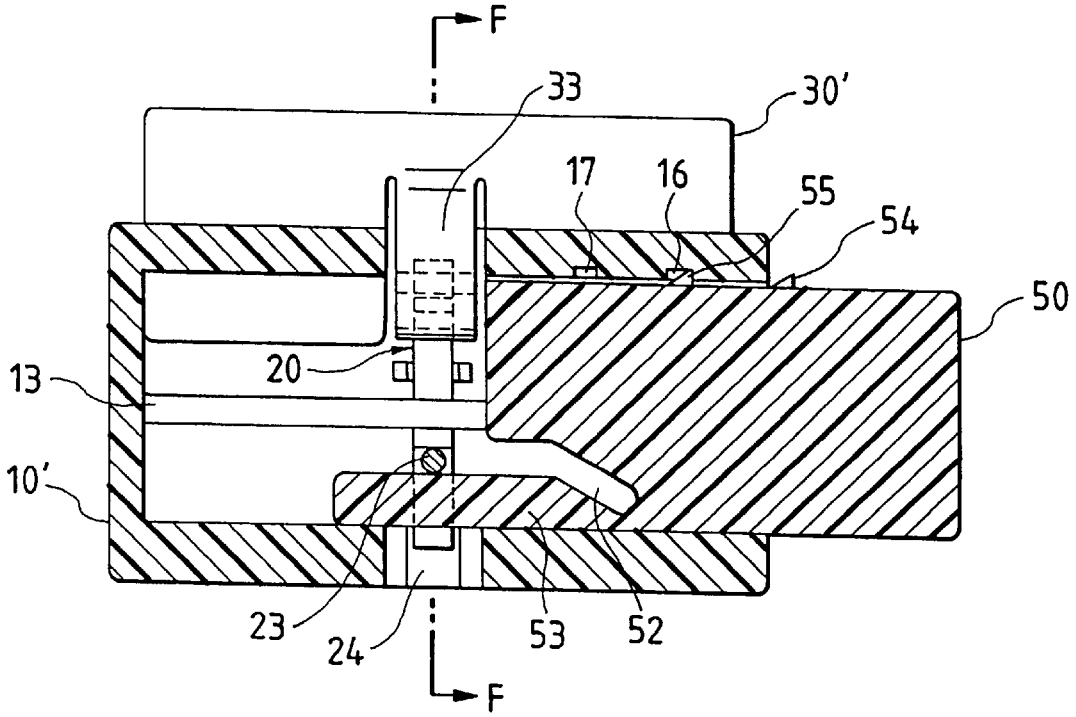
FIGS. 12(*a*) and 12(*b*) show a state just before one and the other connector housings are temporarily secured to each other; in particular, (*a*) is a longitudinal section view of one and the other connector housings, and (*b*) is a section view taken along the direction F—F shown in (*a*)
Figure 12B:
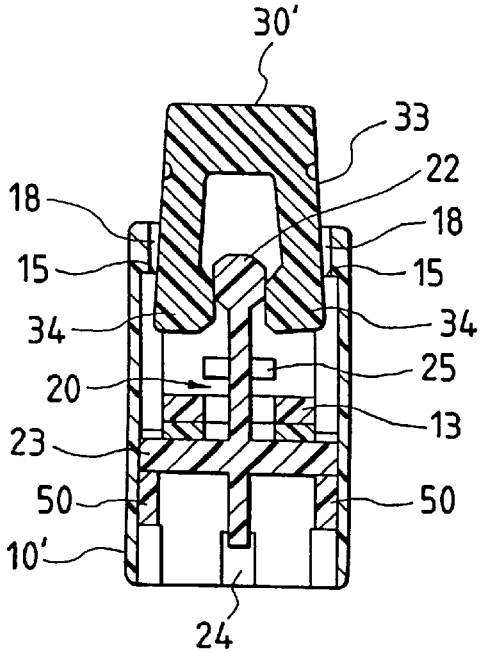
Figure 13A:
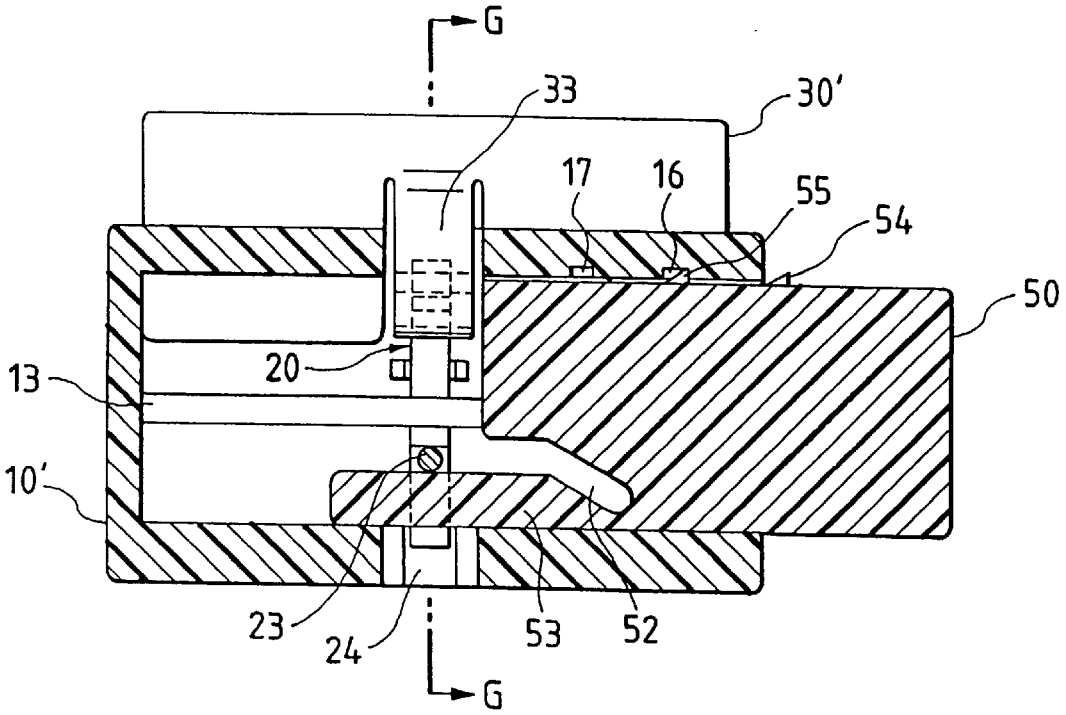
FIGS. 13(*a*)and 13(*b*) show a state just after one and the other connector housings are temporarily secured to each other; in particular, (*a*) is a longitudinal section view of one and the other connector housings, and (*b*) is a section view taken along the direction G—G shown in (*a*)
Figure 13B:
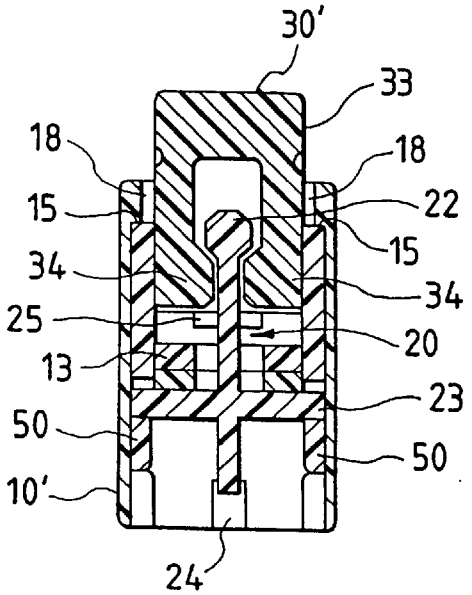

As shown in FIGS. 12(*a*) and (*b*), if the other connector 30' is further pushed in the one connector 10', then the lock arms 33 are opened gradually until they invade into the guide grooves 18, and, as shown in FIGS. 13(*a*) and (*b*), the lock engaging portion 22 is stored into between the lock hold portions 34. At the same time, the lock arms 33 are restored due to their own elasticity to return back to their respective original states. That is, the lock arms 33 are closed. If the lock engaging portion 22 is held by and between the lock arms 33, then one connector 10' and the other connector 30' are secured to each other temporarily. At the then time, since the lock arms 33 are closed, even if the lock engaging portion 22 is going to move out from between the lock arms 33, the lock hold portions 34 prevent the lock engaging portion 22 against removal. Due to this, the temporarily secured state cannot be removed with ease.

Figure 14A:
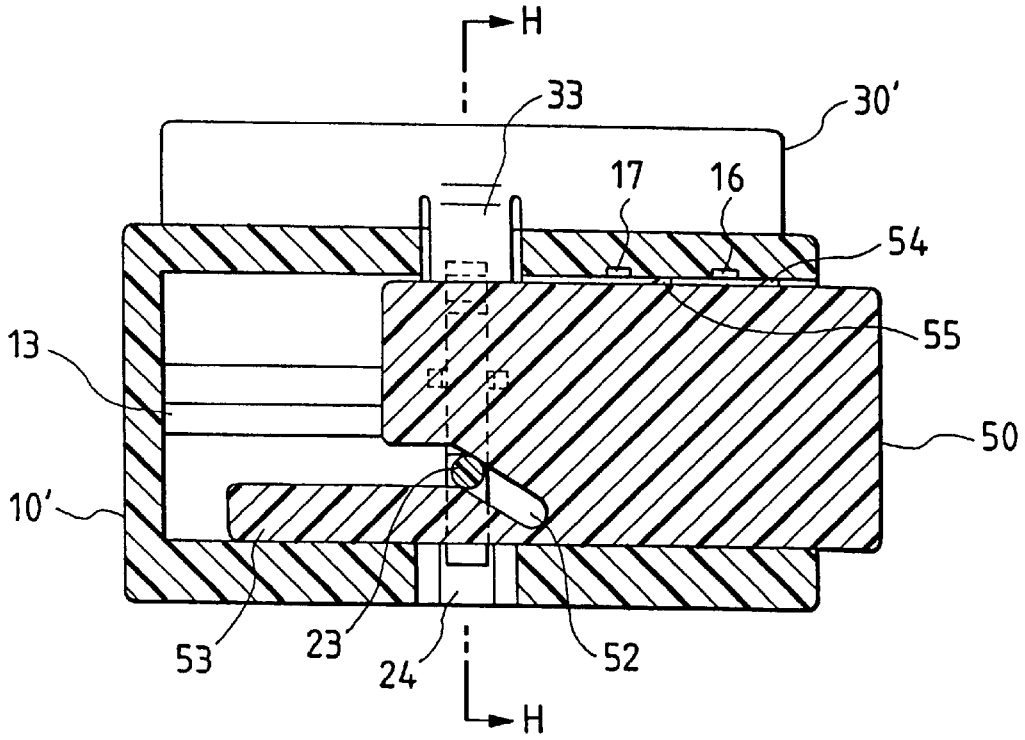
FIGS. 14(*a*) and 14(*b*) show a state in which one and the other connector housings are temporarily secured to each other and the slide member is under insertion; in particular, (*a*) is a longitudinal section view of one and the other connector housings and slide member, and (*b*) is a section view taken along the direction H—H shown in (*a*)
Figure 14B:
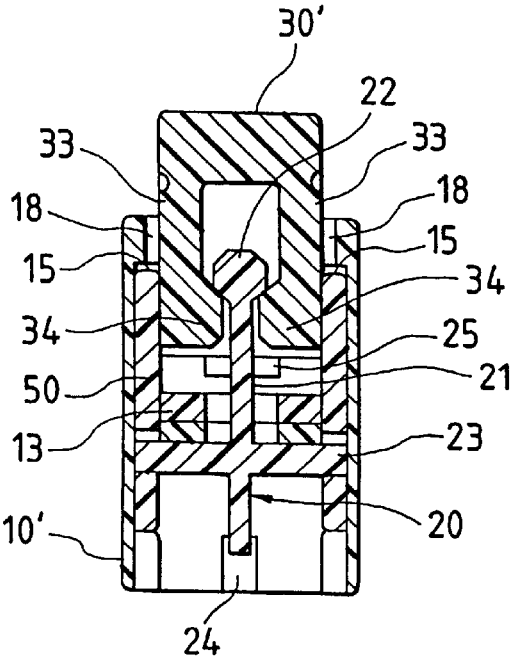

Finally, as shown in FIGS. 14(*a*) and (*b*), in the temporarily secured state of one connector 10' and the other connector 30', if the slide member 50 is pushed in, then the second securing pieces 55 are moved between the first and second securing grooves 16 and 17 while the second securing pieces 55 are being flexed and, at the same time, the cam follower 23 is guided by the guide rails 53 to advance into the cam grooves 52 gradually.

Figure 15A:
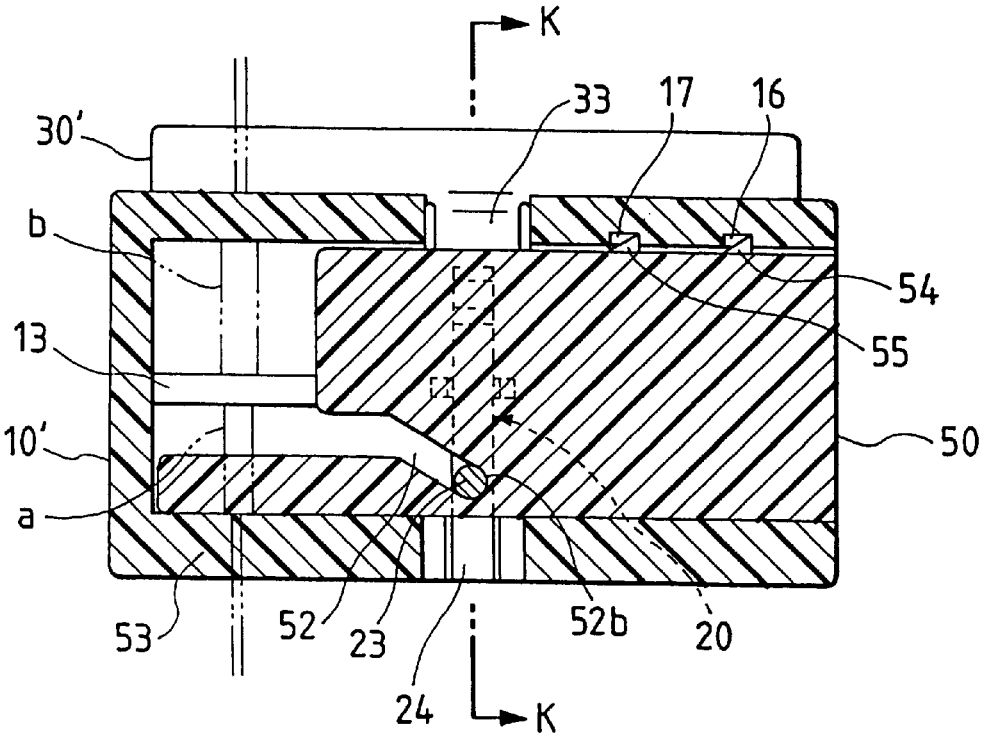
FIGS. 15(*a*) and 15(*b*) show a state in which one and the other connector housings are fitted with each other; in particular, (*a*) is a longitudinal section view of one and the other connector housings, and (*b*) is a section view taken along the direction K—K shown in (*a*).
Figure 15B:
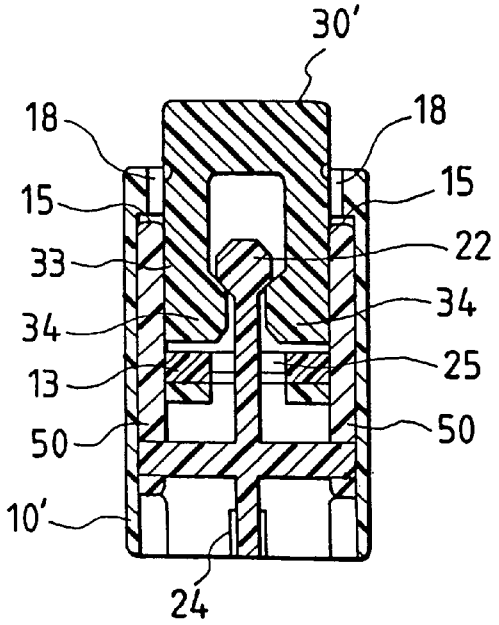

If the slide member 50 is pushed in further, as shown in FIGS. 15(*a*) and (*b*), the cam follower 23 advances into the interior portions of the cam grooves 52 and reaches the inner end portions 52*b* thereof and, at the same time, the first securing pieces 54 are engaged with the first engaging groove 16 and the second securing pieces 55 are engaged with the second securing groove 17. And, the terminal a of one connector 10' is electrically connected with the terminal b of the other connector 30' and, at the same time, one connector 10' is fitted with the other connector 30'.

In the fitting process of one connector 10' with the other connector 30', if one connector 10' is not secured to the other connector 30' temporarily, then the lock engaging portion of the guide member 20 is not engaged with the lock hold portions of the lock arms 33, with the result that the advancement of the slide member 50 into the insertion hole 15 is prevented by the lock arms 33 and thus the slide member 50 cannot be pushed into the insertion hole 15. Due to this, in the fitting operation of one connector 10' and the other connector 30', the half-finished or incomplete fitting between one connector 10' and the other connector 30' can be prevented.

As has been described heretofore, according to the invention, due to the fact that the temporarily secured state between one and the other connector housings 10 and 30 is achieved by the engagement between the lock engaging portion 22 of the guide member 20, which is disposed within one connector housing 10 and is movable advanceably and retreatably in the fitting direction, and the lock hold portions 34 of the lock arms 33 respectively provided in the other connector housing 30 by slits 32, in the temporarily secured state, the lock engaging portion 22 cannot be removed from the lock hold portions 34 easily. In the above-mentioned construction, the lock hold portions 34 can prevent the lock engaging portion 22 from being removed from the lock arms 33. Since there is no possibility that one and the other connector housings 10 and 30 can be separated from each other during the temporarily secured state, the operation to fit one and the other connector housings 10 and 30 with each other can be carried out in such a manner that the two connector housings 10 and 30 can be held in a stable condition.

Also, because the guide member 20 and lock arms 33 are respectively disposed substantially in the central portions of one and the other connector housings 10 and 30, during the temporarily secured state between one and the other connector housings 10 and 30, one and the other connector housings 10 and 30 are prevented from inclining right and left, that is, they can be held in a stable condition. This can improve the balance of one and the other connector housings 10 and 30 during the fitting operation.

Further, since the notches are 36 situated substantially at the central positions of the inner wall surfaces 33*a* of the two longitudinal side walls 31*a* of one connector housing as well as on the fitting side thereof, when the lock arms 33 are engaged with the lock engaging portion 22, the lock arms 33 can be opened with sufficient room. This assures that the lock hold portions 34 can be engaged with the lock engaging portion 22.

In addition, due to the fact that, if one and the other connector housings 10 and 30 are not secured to each other temporarily, then the lock hold portions are not engaged with the lock engaging portion 22 but the lock arms 33 are left open, the lock arms 33 interfere with the slide member 50 and thus keep the same from advancing into one connector housing 10. This can prevent the incomplete or half-finished fitting between one and the other connector housings 10 and 30.

What is claimed is:

1. A low insertion force connector of a slide type, in which a pair of connector housings are fitted with each other by inserting a slide member along a cam mechanism, said connector comprising:

a guide member formed in a central interior portion of one of said connector housings, said connector housings being movable along said guide member in insertion and retraction directions;

a lock engaging portion formed in said interior portion of said one of said connector housings and formed on a fitting side of said guide member;

a pair of flexible lock arms defined by a pair of slits respectively formed in two side walls, said side walls being in a longitudinal direction of the other of said connector housings; and a pair of lock hold portions respectively formed in mutually opposing inner wall surfaces of said lock arms and on the fitting side of the other of said connector housings;

wherein said connector housings are secured to each other by engaging said lock engaging portion with said lock hold portions prior to inserting said slide member along said cam mechanism.

2. The low insertion force connector of a slide type according to claim 1, wherein said guide member is held in a stand-up condition substantially in the central portion of said one connector housing, while said lock arms are situated substantially in the central portion of the other of said connector housings in such a manner that they correspond in position to said guide member.

3. The low insertion force connector of a slide type according to claim 1, wherein said guide grooves for guiding said lock arms are respectively formed in the inner wall surfaces of the two longitudinal side walls of said one of said connector housings and are formed on the fitting side of said one.

4. The low insertion force connector of a slide type according to claim 2, wherein said guide grooves for guiding said lock arms are respectively formed in the inner wall surfaces of the two longitudinal side walls of said one of said connector housing.

* * * * *